US005682128A

United States Patent [19]

Huang

[11] Patent Number: 5,682,128

[45] Date of Patent: Oct. 28, 1997

[54] SUPERCONDUCTING REENTRANT RESONATOR

[75] Inventor: Qiang Huang, Sunnyvale, Calif.

[73] Assignee: Illinois Superconductor Corporation, Mt. Prospect, Ill.

[21] Appl. No.: 636,866

[22] Filed: Apr. 23, 1996

[51] Int. Cl.[6] ..... H01P 1/203

[52] U.S. Cl. ..... 335/216

[58] Field of Search ..... 335/216; 505/1, 505/701, 866, 700–704; 333/219, 204

[56] References Cited

U.S. PATENT DOCUMENTS

| | | | |
|---|---|---|---|
| 2,752,494 | 6/1956 | Finke et al. | 250/36 |
| 3,246,266 | 4/1966 | Racy | 333/83 |
| 3,760,482 | 9/1973 | Kawamura | 29/169.5 |
| 3,872,413 | 3/1975 | Schneider | 333/82 B |
| 4,207,548 | 6/1980 | Graham et al. | 333/225 |
| 4,918,050 | 4/1990 | Dworsky | 505/1 |
| 4,996,188 | 2/1991 | Kommrusch | 505/1 |
| 5,304,968 | 4/1994 | Ohtonen et al. | 333/222 |
| 5,409,889 | 4/1995 | Das | 505/210 |
| 5,434,547 | 7/1995 | Kaida et al. | 333/187 |

*Primary Examiner*—Aditya Krishnan

*Attorney, Agent, or Firm*—Marshall, O'Toole, Gerstein, Murray & Borun

[57] ABSTRACT

A reentrant resonator has a center conductor fixed to an end wall and surrounded by side walls of a housing, where end walls, side walls, and center conductors are all coated with a high-temperature superconducting material. The end walls, side walls, and center conductors are shaped so as to merge smoothly between the side wall and end wall, and end wall and center conductor in order to avoid any corners or right angles. The absence of corners and right angles allows the surface of the coating of high-temperature superconducting material to avoid electromagnetic discontinuities. A cover for the resonator has a tuning device consisting of a bracket receiving a bolt. When the bolt is rotated, an end of the bolt engages the cover to force a surface of the cover closer to the center conductor in order to tune the resonator.

12 Claims, 3 Drawing Sheets

SUPERCONDUCTING REENTRANT RESONATOR

This invention was made with government support under an Advanced Technology Program grant awarded by the United States Department of Commerce.

FIELD OF INVENTION

The present invention relates generally to reentrant electromagnetic resonators and more particularly to reentrant resonators utilizing high-temperature superconductor materials.

BACKGROUND OF THE INVENTION

Conventional reentrant resonators generally include a center conductor, usually made of a metal such as copper or silver, located in a housing having an end wall and side walls made from or coated with a metal. The center conductor is generally mounted on the inside of the housing, perpendicular to the end wall, and spaced from the side walls. The space between the center conductor and the housing side walls may be evacuated or fried with a cavity material such as air, other gases, or a solid dielectric. If the device is a quarter-wave resonator, the length of the center conductor is approximately one-fourth the wavelength in the cavity material of the desired resonant frequency, although, in the reentrant structures addressed herein, the center conductor is typically less than about one-fourth of the wavelength.

Recently, high-temperature superconductors have been studied as components for resonators used in electromagnetic filters. If cooled to its critical temperature, a superconductor exhibits very low electrical resistance and impedance. Those properties make superconductors desirable for electromagnetic filters, because they result in very low signal losses at the resonant frequency. A filter composed of superconducting resonators, therefore, will have a very low insertion loss.

Most presently known high-temperature superconductors are barium cupric oxide ceramics, such as $YBa_2Cu_3O_7$, which have numerous limitations in the manner in which they can be formed into useful structures. Designing superconductive resonators has been difficult, because shapes currently used for resonators having non-superconducting components may not be easily manufactured with ceramics. For instance, in a reentrant resonator where the center conductor is mounted perpendicular to the end wall of the housing, a right angle is present between the center conductor and the end wall. Such a right angle is difficult to create with the high-temperature superconductor ceramics, particularly when the center conductor consists of a coating of superconductive material over a substrate. In addition, right angle junctions in resonators create concentrations of the electromagnetic fields adjacent those junctions and may result in losses, for example, in a band pass filter, at the resonant frequency. While such losses may be insignificant when the resonators are manufactured with ordinary conductors, they may become a primary source of performance degradation when superconductors are used.

Tuning to obtain the desired resonant frequency in conventional reentrant resonators made from metals often consists of changing the resonant structure either by modifying the center conductor or its housing. In many instances, portions of the metal on the housing or center conductor are removed mechanically or by using lasers, until the resonator is tuned to the desired frequency. Such methods are undesirable when superconductors are used, since any removal of material will affect the microstructure of the superconductor, resulting in electromagnetic discontinuity at the modified location. Like the presence of right angles, such a discontinuity may result in additional losses in the resonator.

SUMMARY OF THE INVENTION

In accordance with one aspect of the present invention, a superconducting resonator has a center conductor with an outer surface comprised of a coating of high-temperature superconducting material. A housing defining a cavity has an end wall, and the end wall comprises a coating of high-temperature superconducting material. The outer surface of the center conductor merges smoothly with the end wall of the cavity.

The resonator may have a side wall with a coating of high-temperature superconducting material which merges smoothly with the end wall of the housing. The coating of the outer surface of the center conductor, the coating of the side wall of the housing, and the coating of the end wall of the housing may together comprise a continuous coating.

A cross-section taken through the outer surface of the center conductor, the end wall, and the side wall may have a U-shape. The center conductor has a length and a cross-section taken perpendicular to that length is circular. The at least one side wall of the housing may also have a circular cross-section. The center conductor may have a top surface comprised of a high-temperature superconducting material.

The resonator may have a cover covering the cavity, and the cover may be coated with a high-temperature superconducting material. The resonator may have a tuning device for tuning the resonator by loading the center conductor of the resonator. The tuning device may have a bracket attached to an outer surface of the resonator housing, where the bracket has a threaded opening through which a bolt passes. A contacting end of the bolt contacts the outer surface of the housing to force the housing towards the center conductor. The bracket may be mounted on the cover of the cavity to force the cover towards the center conductor.

Other features and advantages are inherent in the resonator claimed and disclosed, or will become apparent to those skilled in the art from the following detailed description in conjunction with the accompanying drawing.

DETAILED DESCRIPTION OF THE PREFERRED EMBODIMENT

Figure 1:
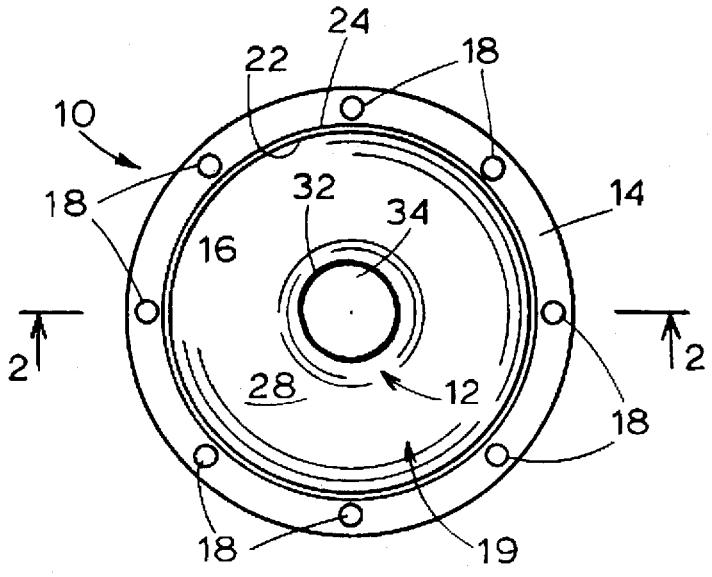
FIG. 1 is a top-plan view of an embodiment of a resonator of the present invention.
Figure 2:
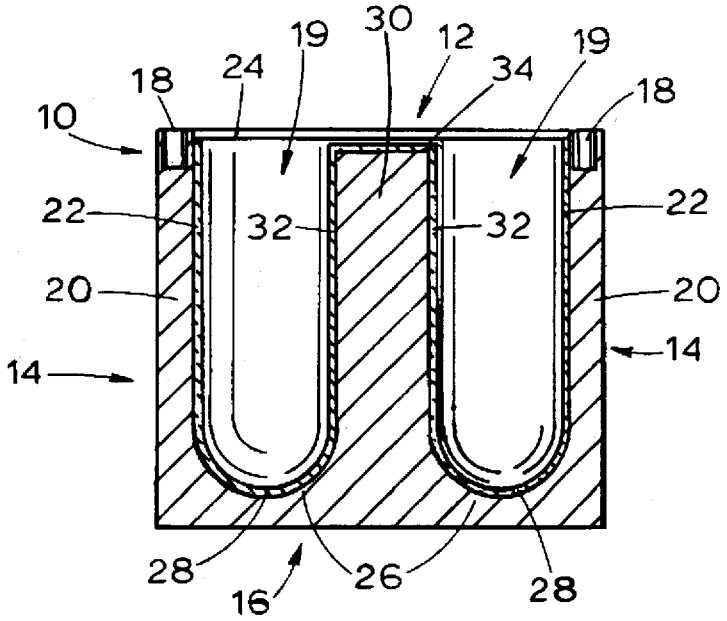
FIG. 2 is a cross-sectional view of the resonator of FIG. 1 taken along the line 2—2 in FIG. 1.

Referring initially to FIGS. 1 and 2, a resonator 10 has a center conductor 12, a circular cross-sectioned side wall 14 and an end wall 16. On the top of the side wall 14 are several threaded openings 18 for receiving bolts (not depicted) to secure a cover over the resonator 10. The side wall 14 and end wall 16 together define a cavity 19 containing the center conductor 12.

The side wall 14 consists of a housing wall 20 with a coating of high-temperature superconducting material 22. (FIG. 2). The coating 22 extends nearly to the top of the housing wall 20 where a small uncoated rim 24 is present. The end wall 16 includes a housing wall 26 with a coating 28 of high-temperature superconductor material. Similarly, the center conductor 12 consists of a post 30 with a coating 32 of high-temperature superconductor material on its sides. The top of the post 32 also has a coating 34 of high-temperature superconductor material.

The interior of the side wall 14 merges smoothly with the interior of the end wall 16 and the center conductor 12 merges smoothly with the interior of the end wall 16 so that a cross section of the resonator 10 as seen in FIG. 2 has two U-shaped sections. Of primary importance is the fact that the outer surface (the surface facing the cavity 19) of the coating 22 on the side wall 14 merges smoothly with the outer surface of the coating 28 on the end wall 16, which in turn merges smoothly with the outer surface of the coating 32 on the center conductor 12. By having the surfaces of the coatings merge smoothly with each other to form a continuous coating, the resonator 10 avoids the concentration of electromagnetic fields which may be present in conventional reentrant resonator designs where right angles or corners are present. Further, smoothly merging surfaces or continuous coating avoids the coating difficulties that would be present if the coating surface had right-angle junctions or other discontinuities. In the embodiment shown in FIG. 2, the housing wall 20, the housing wall 26, and the post 30, which serve as substrates for their respective coatings of superconducting material, all merge smoothly with each other. Smoothly merging or curved outer surfaces of the coatings 22, 28, and 32 could also be formed over discontinuous substrates, leading to varying thickness of coating material. However, such variances are of minimal importance since it is the electromagnetic properties at the surface of the superconducting coating which dominate resonator performance characteristics.

The circular cross-section of the center conductor 12 and the side wall 14 also minimize discontinuities and facilitate coating. It should be noted that a right-angle junction is present at the top end of the center conductor 12 where the coating 34 meets the coating 32. Applying the coating 34, however, presents few difficulties because it is at the end of the center conductor 12, and therefore easily accessible with a coating apparatus. Modeling has demonstrated that the right-angle junctions between the coating 34 and the coating 32, do not generate high electromagnetic fields in the particular resonator design.

The housing wall 20, the housing wall 26, and the post 30 may be made from any suitably sturdy substrate material including a variety of metals such as stainless steel or other alloys such as Inconel™, as well as ceramics such as zirconia, titanate, or alumina. A substrate with a high thermal conductivity is desirable because it aids in removing any heat that is created in the center conductor 12 in order to keep the superconductor in the coatings below its critical temperature. The resonator 10 of the present design, therefore, has cooling advantages over half-wave resonators where the center conductor is isolated from its housing. The coatings 22, 28, and 32 may be of any high-temperature superconducting material, preferably $YBa_2Cu_3O_7$. The superconducting material may be in bulk form or a thin film, but will preferably be a thick film (0.025–0.100 mm thick), and may be applied to the substrates in accordance with any high-temperature superconductor coating method including that disclosed in assignee's U.S. Pat. No. 5,340,797, which is incorporated herein by reference.

Figure 3:
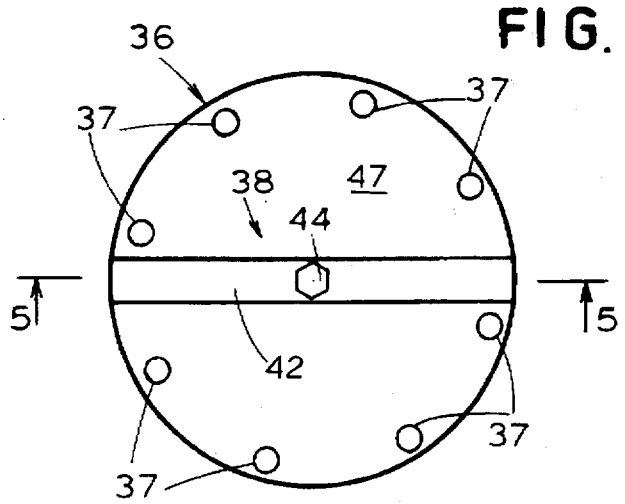
FIG. 3 is a top-plan view of a cover for a resonator of the present invention.
Figure 4:
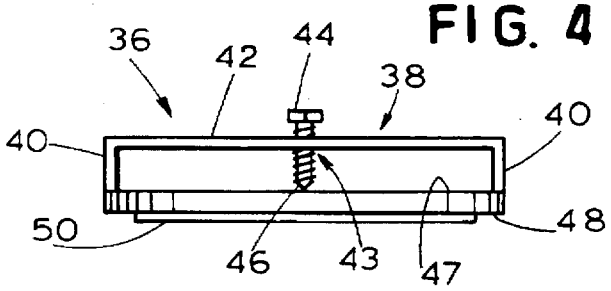
FIG. 4 is a side view of the cover of FIG. 3.

Referring now to FIGS. 3 and 4, a cover 36 has several holes 37 spaced about its periphery. In the center of the cover 36 is a bracket 38 which consists of two legs 40 and a top 42 where the legs 40 are fixed to the cover 36, such as by welding. Passing through a threaded opening 43 in the top 42 of bracket 38 is a bolt 44 having a contacting end 46 which applies pressure to a top surface 47 of the cover 36 when the bolt 44 is rotated clockwise. On a portion of a bottom surface 48 (FIG. 4) of the cover 36 is a coating 50 of high-temperature superconducting material.

Figure 5:
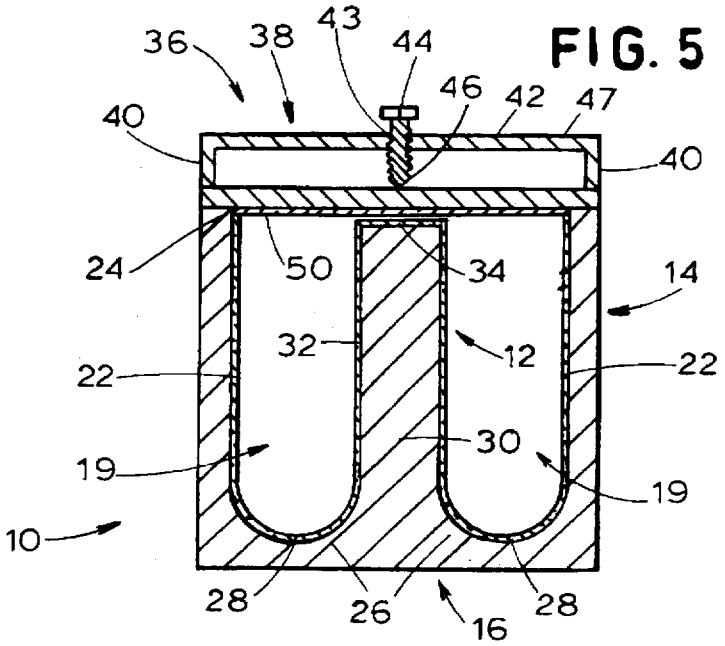
FIG. 5 is a cross-sectional view of the cover of FIG. 3 taken along the line 5—5 of FIG. 3 with the resonator of FIG. 2.

Referring now to FIG. 5, the cover 36 is placed onto the resonator 10 with the threaded openings 18 matching up with the holes 37 so that insertion of bolts (not depicted) through the holes 37 and into the threaded openings 18 will secure the cover 36 to the resonator 10. The rim 24 on the resonator 10 facilitates contact between the coating 50 on the cover 36 and the coating 22 on the side wall 14. The coating 50 on the bottom surface 48 of the cover 36 is adjacent the coating 34 on the top of the center conductor 12. The presence of the coating 34 near the center conductor 12 will load the resonator 10 causing it to resonate at a frequency higher than it would absent the loading. Use of a superconducting coating 50 on the cover 36 is desirable for minimizing losses due to the loading.

If the bolt 44 is tightened so as to apply additional pressure to the top surface 47, the cover 36 will tend to bow downward so that the coating 50 on the bottom surface 48 is moved closer to the coating 34 on the top of the center conductor 12. Thus, by rotating the bolt 44, the resonator 10 can be adjusted to the desired resonant frequency. Furthermore, because rotation of the bolt 44 will provide only minimal deflection of the cover 36, such changes in loading can be implemented accurately.

The cover 36 can be made from a metal such as copper, brass, stainless steel, Inconel™, or aluminum, or may be formed in total or in part of ceramics such as zirconia, titanate, or alumina. If the cover 36 has a coating of superconducting material, the cover materials may be limited due to their melting points which may be exceeded during superconductor processing. The cover 36 may be relatively thin or have a relatively thin section in order to facilitate movement for tuning the resonator. Coupling of electromagnetic signals to or from the resonator 10 can be accomplished in a variety of ways, for instance, by placing openings (not depicted) through the side wall 14 and inserting coupling loops therethrough. Also, before the resonator 10 is cooled to below the superconducting material's critical temperature, it may be desirable to evacuate the resonator 10 or pressurize it with a gas such as helium in order to avoid moisture and other problems associated with air.

Figure 6:
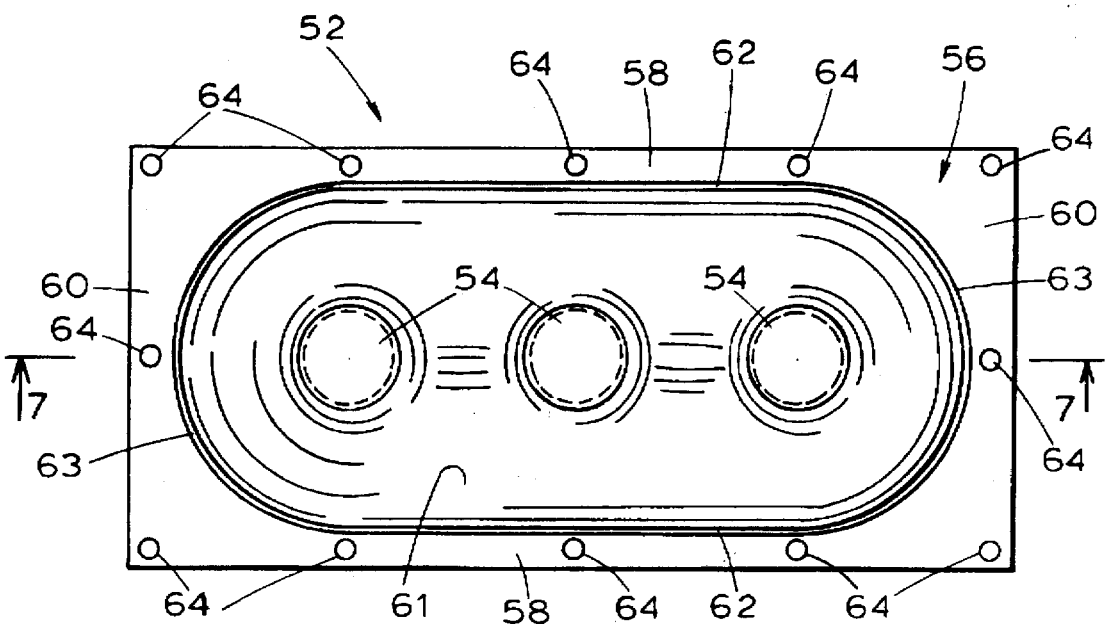
FIG. 6 is a top-plan view of a second embodiment of a resonant structure of the present invention.
Figure 7:
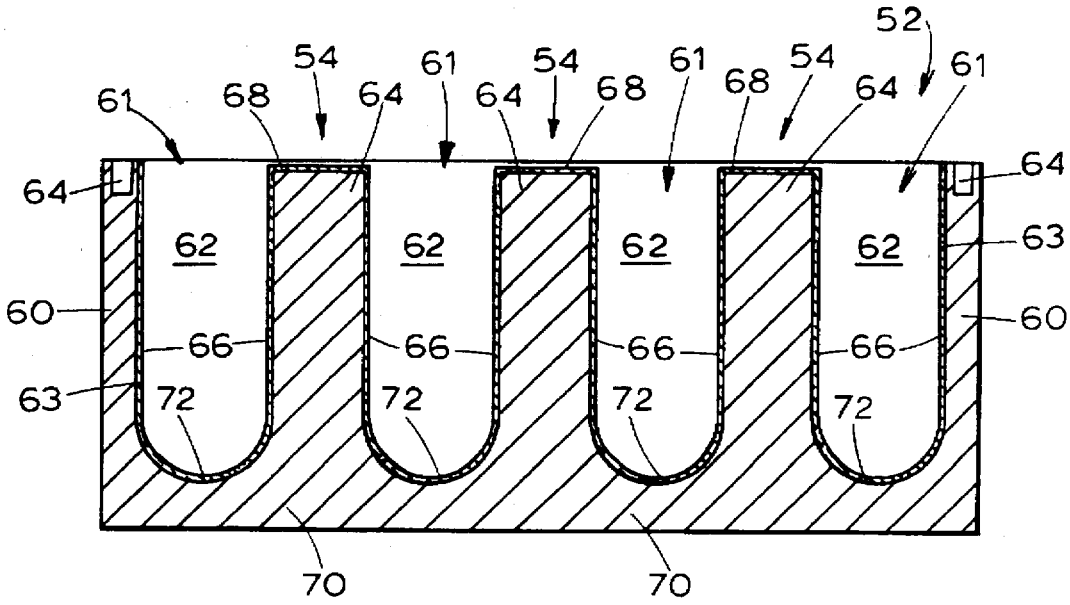
FIG. 7 is a cross-sectional view of the resonant structure of FIG. 6 taken along the line 7—7 in FIG. 6.

Referring now to FIGS. 6 and 7, in another embodiment of the present invention, a resonant structure or filter 52 has three center conductors 54 located within a housing 56. The housing 56 has two long side walls 58 and two short side walls 60 that define a cavity 61 containing the center conductors 54. The side walls 58 and end walls 60 each have a coating 62 and a coating 63, respectively, of high-temperature superconducting material. Several threaded openings 64 are spaced around the periphery of the housing 56 in order to secure a cover (not depicted) to the filter 52. The center conductors 54 consist of posts 64 (FIG. 7) having a coating 66 of high-temperature superconducting material. The posts 64 are also coated on their tops with a coating 68 of high-temperature superconducting material. The posts 64 are secured to an end wall 70 of the housing 56, which also has a coating 72 of high-temperature superconductor material.

Like the resonator 10, the filter 54 avoids any right angles or discontinuities between the side walls, end walls, and center conductors. Therefore, the coatings 62 and 63 on the side walls 58 and 60 merge smoothly with the coating 72 on the end wall 70. Similarly, the coating 72 merges smoothly with the coating 66 on the post 64 of the center conductors 54. In addition, the cavity 61 in the housing 56 has a oval shape without right angles or corners so as to minimize discontinuities and coating difficulties.

Plates (not depicted) with apertures may be placed in the cavity 61 between the center conductors in order to regulate the electromagnetic coupling between adjacent center conductors. The side walls 58 could also be modified so as to protrude into the cavity 61 in order to regulate coupling.

The foregoing detailed description has been given for clearness of understanding only, and no unnecessary limitations should be understood therefrom, as modifications would be obvious to those skilled in the art.

I claim:

1. A superconducting resonator comprising:

a center conductor having an outer surface comprised of a coating of high-temperature superconducting material; and a housing defining a cavity wherein the housing has an end wall and the end wall comprises a coating of high-temperature superconducting material;

wherein the outer surface of the center conductor merges smoothly with the end wall of the cavity.

2. The resonator of claim 1 wherein:

the housing has at least one side wall;

the at least one side wall comprises a coating of high-temperature superconducting material; and the end wall of the housing merges smoothly with at least one side wall of the housing.

3. The resonator of claim 2 wherein the coating of the outer surface of the center conductor, the coating of the side wall of the housing and the coating of the end wall of the housing together comprise a continuous coating.

4. The resonator of claim 2 wherein a cross-section through the outer surface of the center conductor, the end wall and the side wall has a U-shape.

5. The resonator of claim 1 wherein;

the center conductor has a length; and a cross-section taken perpendicular to the length of the center conductor is circular.

6. The resonator of claim 1 wherein the at least one side wall of the housing has a circular cross-section.

7. The resonator of claim 1 wherein the center conductor has a top surface comprised of a high-temperature superconducting material.

8. The resonator of claim 1 comprising a cover covering the cavity.

9. The resonator of claim 8 wherein the cover has a coating of high-temperature superconducting material.

10. The resonator of claim 8 wherein the cover has a tuning device comprising:

a bracket attached to an outer surface of the cover;

a threaded opening in the bracket; and a bolt having a contacting end wherein the bolt is located in the threaded opening;

wherein the contacting end contacts the outer surface of the cover to force the cover toward the center conductor.

11. A tuning device for tuning a resonator by loading a center conductor located in a housing of the resonator, the tuning device comprising:

a bracket attached to an outer surface of the housing;

a threaded opening in the bracket; and a bolt having a contacting end wherein the bolt is located in the threaded opening;

wherein the contacting end contacts the outer surface of the housing to force the housing toward the center conductor.

12. The tuning device of claim 11 wherein:

the housing has a cover;

the bracket is attached to the cover; and the bolt forces the cover toward the center conductor to tune the resonator.

* * * * *

UNITED STATES PATENT AND TRADEMARK OFFICE

CERTIFICATE OF CORRECTION

PATENT NO. : 5,682,128

DATED : October 28, 1997

INVENTOR(S) : Huang

It is certified that error appears in the above-identified patent and that said Letters Patent is hereby corrected as shown below:

Column 1, line 22, delete "fried" and insert --filled--.

Signed and Sealed this

Fifth Day of May, 1998

*Attest:*

*Attesting Officer*

BRUCE LEHMAN

*Commissioner of Patents and Trademarks*